US005255824A

United States Patent [19]

Filella Pablos

[11] Patent Number: 5,255,824

[45] Date of Patent: Oct. 26, 1993

[54] TABLE SERVICE FOR DISPENSING LIQUID AND SOLID CONDIMENTS

[75] Inventor: José Luis Filella Pablos, Barcelona, Spain

[73] Assignee: Industria Auxiliar Manodomesticos, S.A., Alforja, Spain

[21] Appl. No.: 841,796

[22] Filed: Feb. 26, 1992

[30] Foreign Application Priority Data

Feb. 28, 1991 [ES] Spain ..... 9100510

[51] Int. Cl.[5] ..... B67D 5/06

[52] U.S. Cl. ..... 222/179.5; 222/192; 248/146

[58] Field of Search ..... 222/142.1, 142.3, 129, 222/173, 179.5, 192; 248/146, 311.2; 211/71, 74

[56] References Cited

U.S. PATENT DOCUMENTS

| | | | |
|---|---|---|---|
| 1,352,004 | 9/1920 | Kessel | 222/179.5 |
| 1,761,382 | 6/1930 | Akalis | 222/179.5 |
| 2,292,651 | 8/1942 | Olevin | 222/179.5 |
| 2,580,521 | 1/1952 | Couchot | 222/142.1 |

FOREIGN PATENT DOCUMENTS

| | | |
|---|---|---|
| 1084479 | 1/1955 | France . |
| 2026665 | 9/1970 | France . |
| 206305 | 2/1976 | Spain . |

*Primary Examiner*—Andres Kashnikow
*Assistant Examiner*—Philippe Derahshani
*Attorney, Agent, or Firm*—Sughrue, Mion, Zinn, Macpeak & Seas

[57] ABSTRACT

The cable service comprises containers for condiments and a support and holding body member; each container is provided with a head member provided with a dihedral concave recess forming a first horizontal area, in which there is the spout or the orifices and a second vertical area. The support and holding body member, for each container, is provided with a front wall which is engaged by the second area and the front wall is limited at the bottom by a horizontal edge, immediately under which there is situated the first area, penetrating in the body member furthermore the body member is provided with complementary retaining means which preferably act on the lower portion of the container. This provides protection for the spout and orifices and prevents the containers from coming accidentally apart.

13 Claims, 6 Drawing Sheets

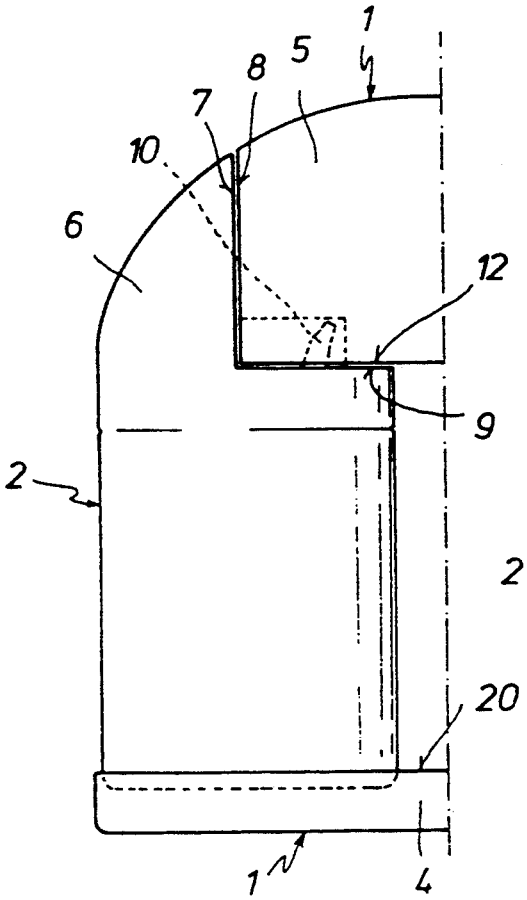
FIG. 1
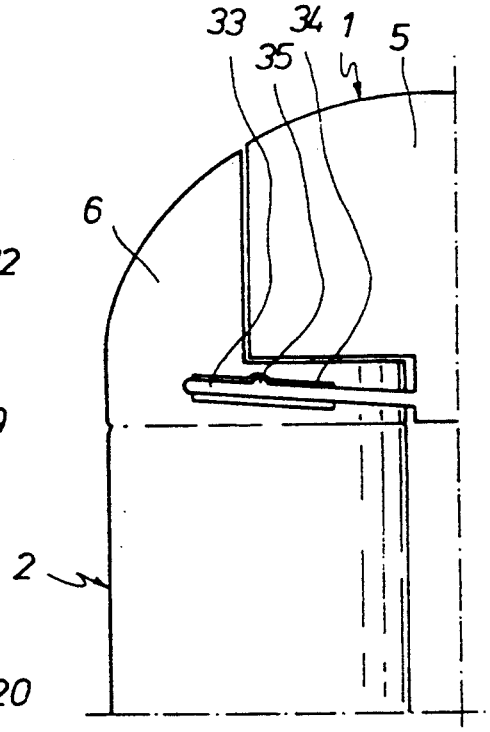
FIG. 6
FIG. 4
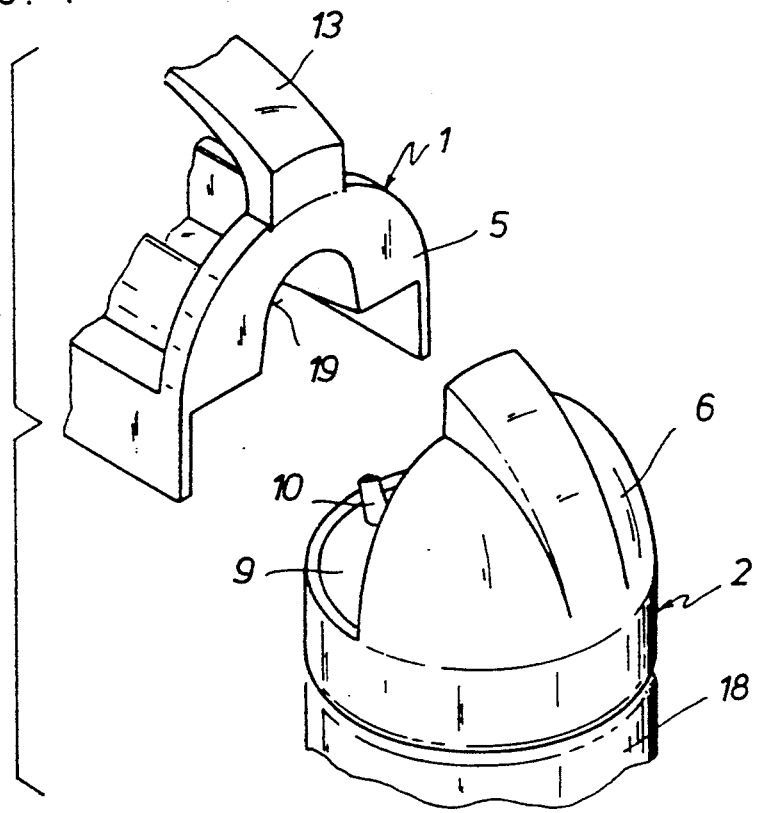

TABLE SERVICE FOR DISPENSING LIQUID AND SOLID CONDIMENTS

BACKGROUND OF THE INVENTION

1. Field of the Invention

The present invention relates to a table service comprising: a) a support and holding body member having an upper portion provided with holding means and a lower portion for support, the resting of said body member on a horizontal surface determining a first rest position of said body member; and b) at least one dispensing container which has a bottom wall, which may be placed on said lower support portion and which is provided with a head member comprising dispensing means, the placing of a container on said lower support portion determining a second inactive position of the container.

2. Prior Art

The table services for dispensing liquid or solid condiments in table service, traditionally known as cruets, are conventionally formed by containers for liquid condiments, such as oil and vinegar, provided with a spout (oil bottles), nozzle or pouring beak, with a filling stopper and, optionally, handling means, such as handles. Said containers are placed on a drip collector plate, in the case of individual containers, or on a tray, in a basket or the like, provided with housings for the containers and a handle, in the case of grouped containers or ensembles. Complementarily to said liquid containers, there are the containers for sprinkling a solid condiment, such as salt or pepper, which are provided with dispensing or sprinkling holes disposed, in general, in the filling stoppers.

Currently, table services of the type formed by sets of oil cruet, vinegar cruet, salt pot and pepper pot are used. The components thereof, as explained above, are located in housings provided in brackets or support body members provided with a handle for manual holding in the fist or hanging from one or two fingers, which group together not only the oil and vinegar cruets or the salt pot or pepper pot or all of them. Spanish Patent 87000358 discloses a set of this type.

In all cases, the pouring beaks or nozzles of the oil and vinegar bottles and the sprinkler holes of the salt and pepper pots are uncovered, whereby said parts are exposed to environmental pollution, insects, splashing in various ways (coughing, sneezing, etc.) and, others, whereby they suffer from insufficient hygiene.

To overcome this drawback, various solutions have been proposed such as providing a cap or stopper which encloses the container head end at the top, a rocking or sliding lid covering said pouring beaks or nozzles and sprinkling holes, which is operated with the same hand as the one manipulating the container, preventing the ingress of foreign matter and the vertical placement of the plane of the outlet orifices of the beaks and holes of the containers, which makes such ingress of foreign matter difficult. Within these types of containers for oil cruets or vinegar cruets for table or kitchen use, there may be cited those disclosed in Spanish utility models 56,986, 205,800 and 206,305, in which the first and the third disclose a rocking lid and the second one a closure cap.

To summarize, it should be pointed out that, in general, among such containers for table service, those having a free or open head end are convenient to use, but are not hygienic and those having closed head ends are hygienic but not convenient to use.

Furthermore, it is desirable that the containers be placed in the support and holding body member with a high degree of security, such that an alteration of the position of the support and holding body member during carrying or use thereof does not involve a risk of the containers becoming separated.

Thus, with a view to solving said problems, table services are desirable in which, in turn, the containers have the hygiene of the covered head ends and the convenience of the free or uncovered head ends, as well as a security which may be compared with that attained by some conventional table services.

To this end, it is an object of the invention to provide a solution according to which the free head end containers, when out of use, have the active portion of the head ends covered by portions of the support and holding body member, thereby isolating said active parts (pouring beaks and nozzles and sprinkler holes) from contact with the environment, while at the same time allowing the containers to be removed from and reinserted in the support and holding body member easily and conveniently.

SUMMARY OF THE INVENTION

The above object is attained by a table service of the type first mentioned above, wherein each head end is provided with a concave recessed portion which, when the body member is in the said first position and the container is in said second position, determines a first generally horizontal area in which there are said dispensing means and a second generally vertical area, while the support body member, for each container, is provided with a front wall adapted to be engaged by said second area, and which is limited at the bottom end by an edge which, when said body member is in said first position, is generally horizontal, immediately below which there is situated said first area when the container is in the second position thereof, and wherein said support body member is provided, for each container, with complementary means retaining the container is said second position.

BRIEF DESCRIPTION OF THE DRAWING

Hereinafter there are explained and described drawings which illustrate the different features of the invention. The FIGS. show:

FIG. 1, a part elevation view of the table service of the invention, there being seen one container and only a part of the support and holding body member.

FIG. 4, a part perspective view of the upper portion of the support and holding body member and the head end of a container for liquids.

FIG. 6, a part elevation view of the table service, showing one container and the upper portion of the support and holding body member, respectively provided with a slot and a spigot housable therein.

DETAILED DESCRIPTION OF THE INVENTION

Figure 2:
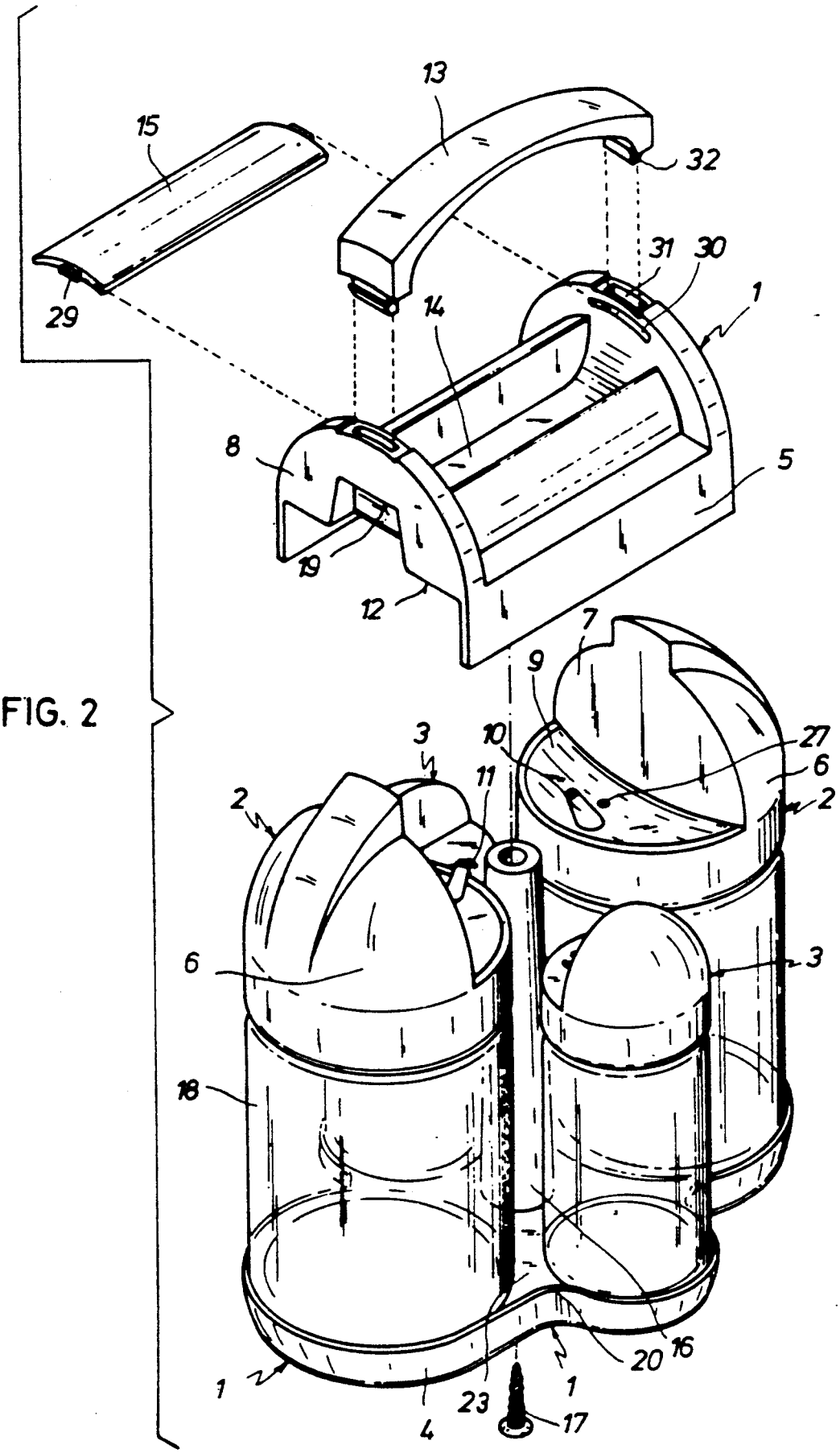
FIG. 2, a perspective, partly exploded view, of a preferred embodiment of the present table service.

The table service of the present invention comprises a support and holding body member 1 and containers 2, 3. The support and holding body member 1 has a lower portion 4, on which the containers 2, 3 may be located, and an upper portion 5. These two portions are connected by at least one column 16, situated preferably centrally of the support and holding body member 1; as necessary a screw 17 fixes the column. Herein, the position in which the support and holding body member 1 is resting on a horizontal surface is called the first rest position thereof.

Each container 2, 3 comprises a conventional receptacle 18 the interior of which is for storing either liquid products or condiments, preferably oil or vinegar (containers 2) or solid condiments in powdered product form, such as salt, pepper or others (containers 3). Herein, the position of the container 2, 3 when placed on the lower portion 4 of the body member 1 is called second inactive position.

Each of the containers 2, 3 is provided with a bottom wall 22 and at the top is closed by a head member 6, provided with dispensing means, such as a pouring spout 10 for the containers 2 or sprinkling holes 11 for the containers 3.

Each of the head members 6 is provided with a concave recess which, when the support and holding body member 1 is in the first position thereof and the container 2, 3 is in the second position thereof (i.e., when the container is resting on a horizontal plane such as the lower portion 4 of the support and holding body member 1, with the portion 4 also being in a horizontal position) determines a first generally horizontal area 9 on which there are located the dispensing means 10, 11 and a second generally vertical area 7. Preferably, the concave recess is a dihedron as shown in the Figures and, therefore, both areas 7, 9 are generally flat and define a right diehedral angle.

The support and holding body member 1, for each container 2, 3, is provided with a front wall 8 which is adapted to be engaged by, i.e. be immediately facing the second area 7 of a head member 6. In the above mentioned preferred case where the recess is a right dihedron, the front wall 8 is also generally flat. In all cases, the front wall 8 is bounded by a lower edge 12 which is positioned horizontally when the support and holding body member 1 is in the first position thereof. In turn, when the container 2, 3 is in the second position, the first area 9 of the convex recess of the head member 6 is situated immediately below the edge 12 and therefore is covered by the upper portion 5 of the support and holding body member 1.

In the case of containers 2 for liquids, which are provided with a pouring spout 10, it is contemplated that the lower edge 12 of the front wall 8 be provided with a recess 19 to allow the passage of the spout when moving the container 2 towards or from the second position, i.e. when replacing or removing the container 2.

The invention also contemplates that, for each of the containers 2, 3 it may contain, the support and holding body member 1 should be provided with complementary means for retaining the container 2, 3 in the second position. With this designation of complementary retaining means, the intention is to designate means which alone are not capable of effecting such retaining action, but which are effective in cooperating with the coupling arrangement between the support and holding body member 1 and containers 2, 3 constituted by the described configuration of the concave recesses of the head members 6 and the front wall 8 and edge 12 of the upper portion 5, as described hereinafter.

Preferably the complementary retaining means comprise a lip 20 situated on the lower portion 4 of the support and holding body member 1 and which surrounds at least in part the bottom wall 22 of the container 2, 3 when the latter is in the second position. Habitually, this lip 20 (FIGS. 9 and 10) is a peripheral edge relative to the whole of the lower portion 4 of the support and holding body member 1.

With regard to the liquid containers 2, it should be pointed out that instead of the lip 20 (or additionally thereto), the complementary retaining means may also comprise a stop member 21 situated close to the recess 19. This stop member 21 is an impediment for the pouring spout 10, when the latter is moving in a horizontal line from the second position of the container 2.

Figure 3:
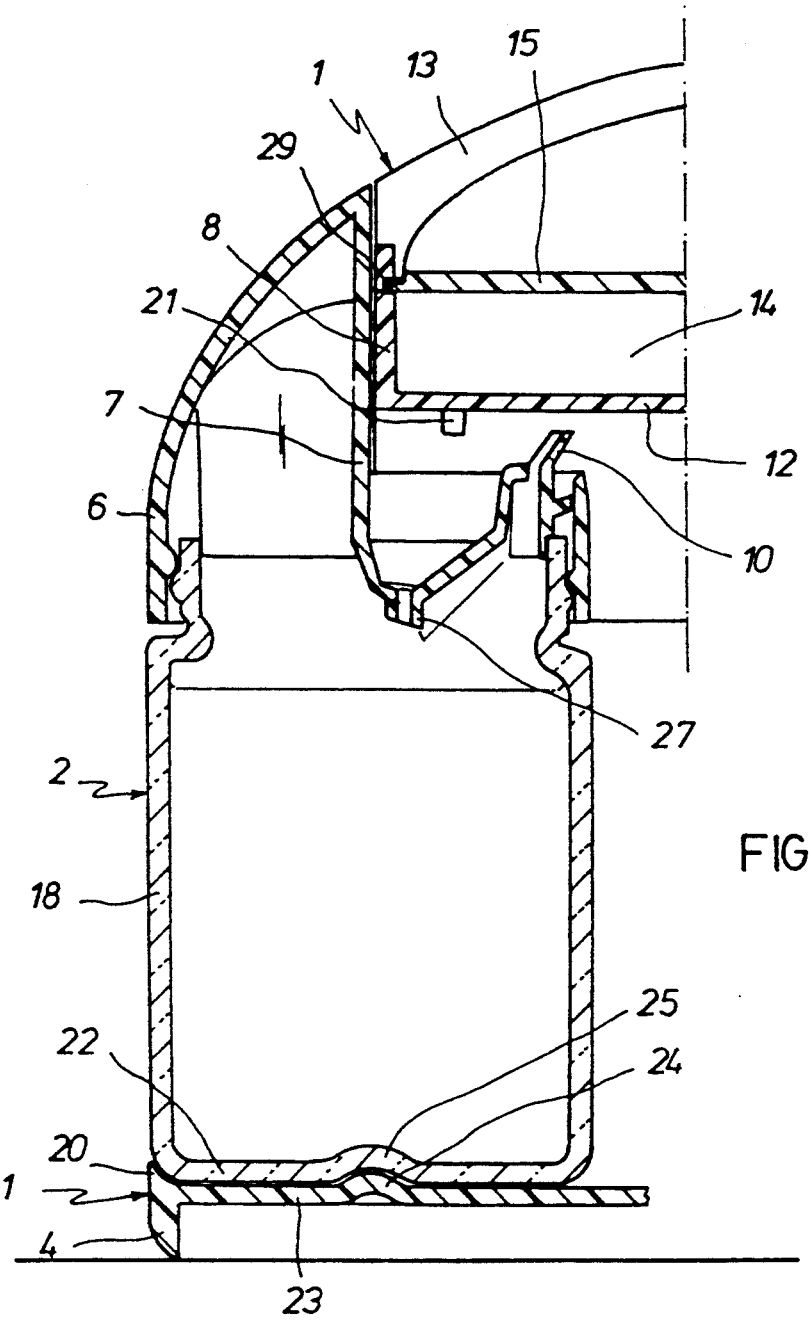
FIG. 3, a cross section on a vertical plane of a container and of only part of the support and holding body, the bridge-like arcuate arm being shown unsectioned.

Another embodiment of the complementary retaining means is formed by a protuberance 24 (FIG. 3) situated in the base 23 of the lower portion 4 of the support and holding body member 1. This protuberance is complemented by a recess 25 in the centre of the bottom wall 22 of the receptacle 18, whereby the movement of the container 2, 3 along a horizontal path starting out from the second position of the container 2, 3 itself is also hindered.

Figure 7:
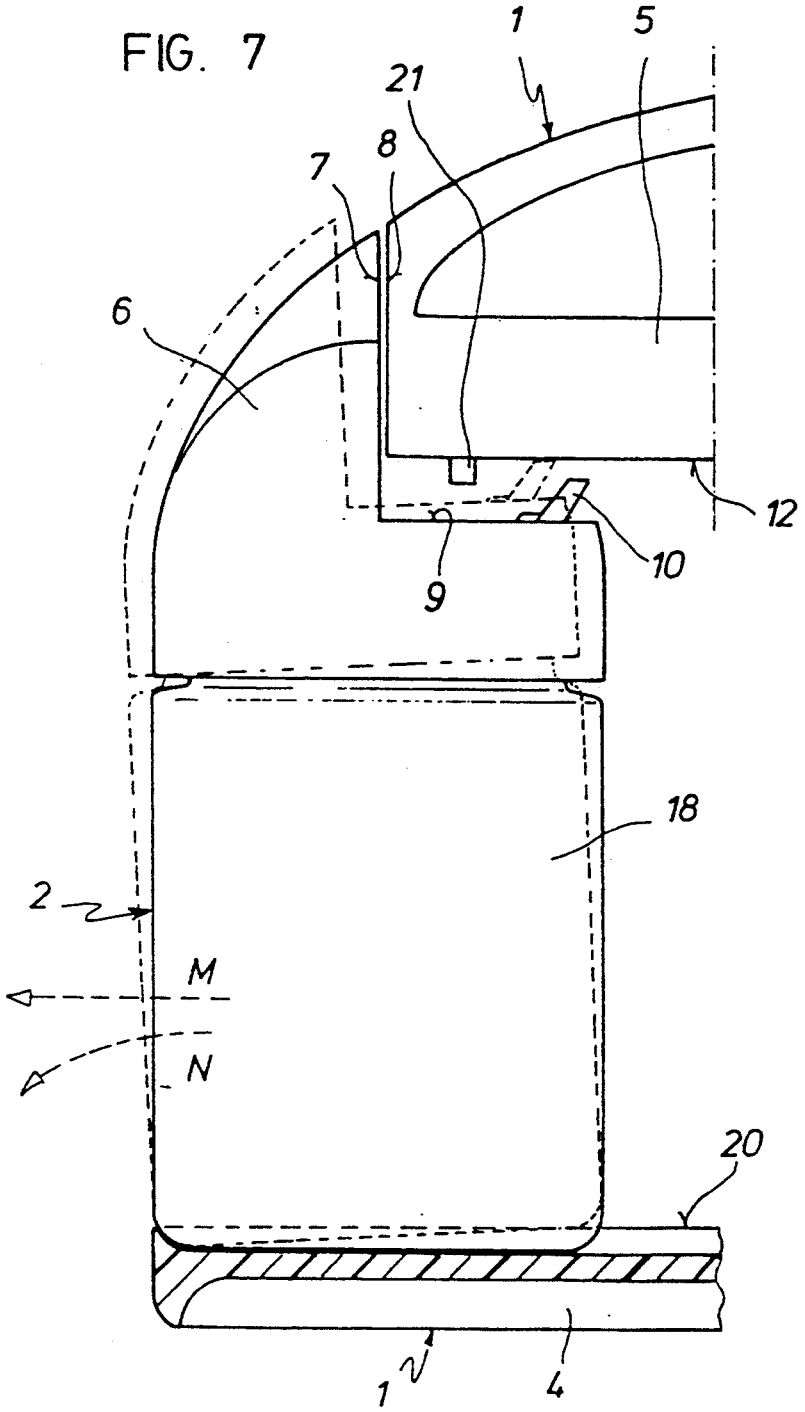
FIG. 7, an elevation view of a container for liquids, in the second position thereof, and partly of the support and holding body member of which the lower portion is shown in section, the retaining position of the container being shown in phantom trace.
Figure 8:
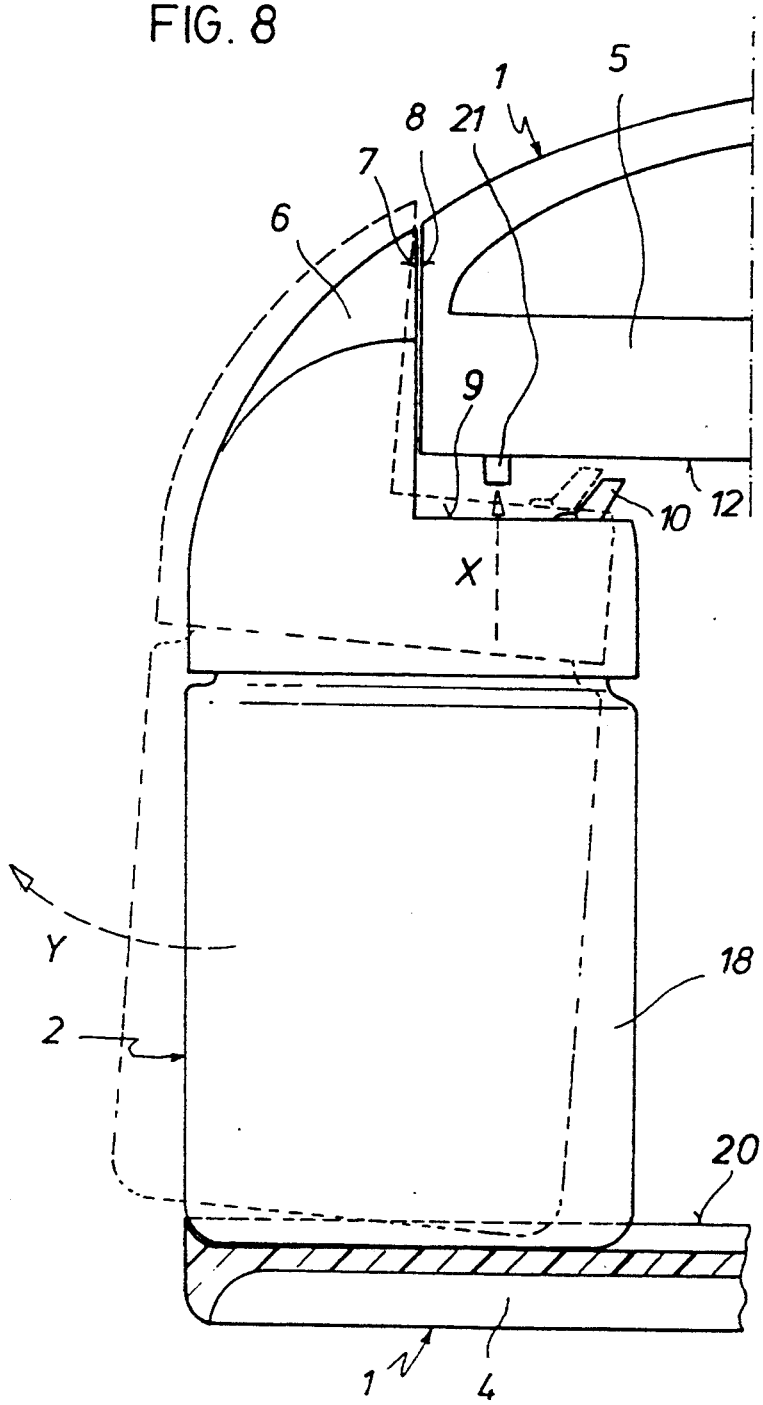
FIG. 8, an elevation view of a container for liquids, in the second position thereof, and partly of the support and holding body member of which the lower portion is shown in section, an intermediate position of the container during the correct movement thereof for removal from the support and holding body member being shown in phantom trace.

Thereafter, in the light of FIGS. 7 and 8, there are described the possibilities of removing a container 2, 3 from the second position thereof in the body 1. In this second position, a container 2 rests on the lower portion 4 of the body member 1 and the bottom wall thereof is surrounded at least in part by the rim 20. In turn, the concave dihedral recess of the head member 6 is located with the second area 7 thereof engaging the front wall 8 of the upper portion 5 of the body member 1, while the first area 9 is beneath the edge 12.

As shown in FIG. 7, the rim 20 makes a horizontal movement (in the direction of the arrow M) impossible for removal of the container 2. It should also be appreciated that the resistance offered by the rim 20 causes the container 2 to tilt in the direction of the arrow N, whereby the spout 10 engages the upper portion 5 of the body member 1, preventing the movement from continuing and, therefore, the removal of the container 2.

It is noted that in a further embodiment, of special interest where there is no spout 10, the first area 9 is situated closer to the edge 12 whereby, when the container tilts, it is this first area 9 which engages the upper portion 5.

In FIG. 8 the container is seen to be tilting in the direction of the arrow Y; by tilting in this way (accompanied, as necessary, with a slight prior lifting in the direction of the arrow X), the bottom wall the receptacle 18 becomes free of the rim 20 and it is possible to continue tilting without any interference between the spout 10 or first area 9 with the upper portion 5 of the body member 1. Therefore, with the simple movements shown, it is easy to remove the container from the body member 1.

Further features of the invention are mentioned in the following paragraphs.

Figure 5:
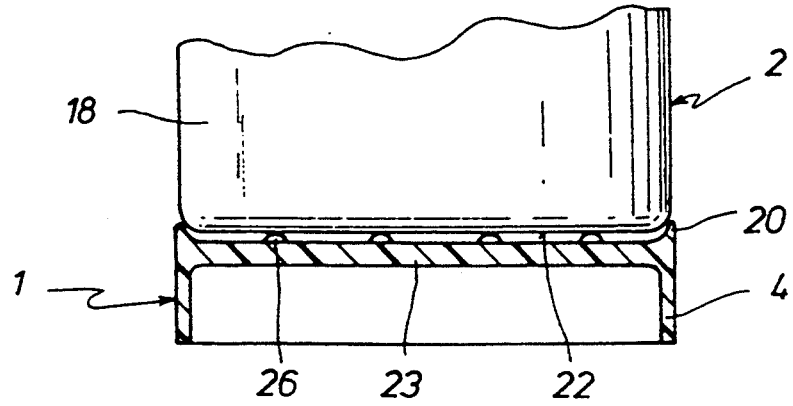
FIG. 5, a part elevation view of the lower portion of a container, showing the lower portion of the support and holding body member, provided with protuberances, in section.

The invention also contemplates the existence of protuberances 26 (FIG. 5) on the lower portion 4 of the body member 1, to keep the bottom wall of the container 2, 3 dry.

The first area 9 of the head member 6 (FIG. 3) is slightly sloping to allow the draining of drops from the spout 10 to an orifice 27 in communication with the interior of the receptacle 18.

So that the various containers may be more stable and have a considerable capacity, there are deemed to be preferable dimensional features such that, for the liquid containers 2, the height to transverse size ratio is 2 to 1, whereas for the solids containers 3, the ratio is 3 to 1.

To facilitate the carrying of the container set, the support and holding body member 1 is provided at the top portion 5 thereof with suitable means, preferably an arcuate bridge-like arm 13, provided to extend over one of the major dimensions of said upper portion.

Preferably the arcuate arm 13 (FIG. 2) is provided with resilient assembly feet 32 which are retentively attached in slots 31.

According to another embodiment (FIG. 6), one or more containers 2, 3 are provided with at least on set formed by two members, which are a sloping slot 34 and an also sloping spigot 33 which may be engaged in the slot 34. Preferably the slot 34 is provided on the container 2, 3, while the spigot is fixedly attached to the upper portion 5 of the body member 1, although the arrangement may be reversed. The slope is downward towards the upper portion 5, whereby the containers 2,3 tend to approach the body member 1 by gravity.

Figure 9:
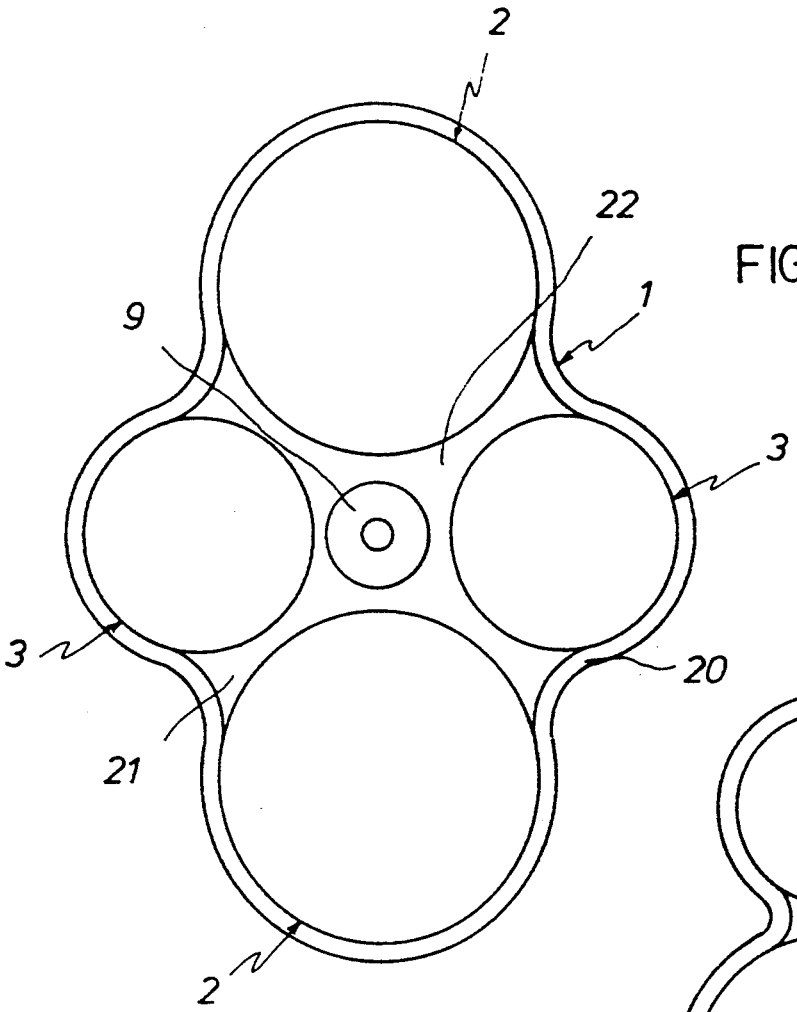
FIG. 9, a plan view of the lower portion of the support and holding body member and with a schematic showing of the containers, of the same embodiment as shown in FIG. 2.
Figure 10:
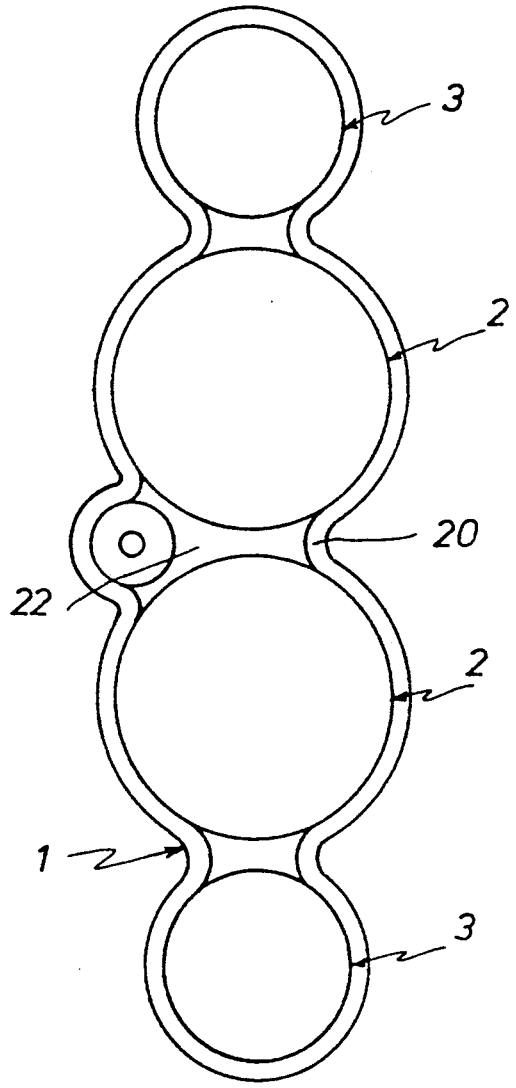
FIG. 10, a plan view of the lower portion of the support and holding body member and with a schematic showing of the containers, according to a different embodiment.

The containers 2,3 preferably are disposed as shown in FIGS. 2 and 9, whereby the lower portion has the profile shown in FIG. 9. Other arrangements are also contemplated, such as the aligned one of FIG. 10. Obviously other embodiments with a different number of containers are possible.

The invention also contemplates that the upper portion 5 of the support and holding body member is provided with a recessed portion 14 for containing small sized objects, particularly tooth-picks. There is preferably also a cover 15 movable between a position in which it covers the recessed portion 14 and other positions in which it leaves it uncovered; for such movement, there provided teeth 29 situated at the respective ends of the cover and adapted to be inserted in respective slots 30 formed in the said upper portion 5. The movement of the cover also preferably describes an arcuate path; to this end, both the cover 15 and the slots 30 will be appropriately shaped.

What I claim is:

1. A table service comprising:

a) a support and holding body member having an upper portion provided with holding means and a lower portion for support, the resting of said support and holding body member on a horizontal surface determining a first rest position of said support and holding body member; and b) at least one dispensing container which has a bottom wall, which may be placed on said lower support portion and which is provided with a head member comprising dispensing means, the placing of said at least one container on said lower support portion determining a second inactive position of said at least one container, wherein at least one head member is provided with a concave recessed portion which, when the body member is in said first position and said at least one container is in said second position, determines a first generally horizontal area in which there are said dispensing means and a second generally vertical area, while the support and holding body member, for said at least one container, is provided with a front wall adapted to be engaged by said second area and having a bottom end which is limited by an edge which, when said support and holding body member is in said first position, is generally horizontal, immediately below which there is situated said first area when said at least one container is in the second position thereof, and in that said support and holding body member is provided, for said at least one container, with complementary means retaining said at least one container in said second position.

2. The table service of claim 1, wherein said concave recess has a dihedral shape and said first and second areas and said front wall are generally flat.

3. The table service of claim 1, wherein when said at least one container is for containing liquids and said dispensing means comprises a pouring spout, said front wall is provided with a recess open at the bottom to allow the passage of said pouring spout during the movement of said at least one container towards or from the second position thereof.

4. The table service of claim 1, wherein when said at least one container is for containing powdered products and said dispensing means comprises sprinkling orifices, said edge is substantially continuous.

5. The table service of claim 3, wherein said upper portion of the support and holding body member comprises a stop projection situated close to said recess and is adapted to form an obstacle for said spout when this is moved in a horizontal path towards or from the second position of said at least one container, with said support and holding body member being in said first position.

6. The table service of claim 1, wherein said complementary retaining means comprises a lip situated on said lower support portion and which at least partly surrounds said bottom wall of said at least one container, when the latter is in the second position thereof.

7. The table service of claim 1, wherein said complementary retaining means comprises a protuberance situated on said lower support portion and a complementary recess in the center of said bottom wall of said at least one container capable of receiving said protuberance.

8. The table service of claim 1, wherein for at least one container it is provided with at least one set of two sloping members, respectively a slot and a spigot engageable in the slot, one of said members being located on the support and holding body member and the other member being located on said at least one container such that when the support and holding body member is in the first position thereof and said at least one container is in the second position thereof, said slope tends to move said at least one container towards the support and holding body member.

9. The table service of any one of claim 1, wherein said lower portion of said support and holding body member is provided with low protuberances for seating the bottom wall of at least one container.

10. The table service of any one of claim 1, wherein the upper portion and the lower portion of the support and holding body member are associated by at least one column.

11. The table service of any one of claim 1, wherein said support and holding body member is provided with holding means formed by an upwardly extending bridge-like arcuate arm which is provided with two end feet which are attached respectively in areas of the upper portion of the support and holding body member.

12. The table service of any one of claim 1, wherein it comprises a pair of containers for containing liquids and a pair of containers for containing powdered products, each pair of containers being mutually facing when in the second position thereof.

13. The table service of claim 1, wherein the upper portion of the support and holding body member is provided with a recessed portion, there being a cover movable between a position in which it covers said recessed portion and positions in which it does not cover it.

* * * * *